US005746638A

United States Patent [19]

Shiraishi

[11] Patent Number: 5,746,638

[45] Date of Patent: May 5, 1998

[54] MAGNETIC TOY BLOCKS

[75] Inventor: Masami Shiraishi, Tiba, Japan

[73] Assignee: Stuff Mfg. Co., Ltd., Tokyo, Japan

[21] Appl. No.: 705,687

[22] Filed: Aug. 29, 1996

Related U.S. Application Data

[63] Continuation of Ser. No. 523,491, Sep. 1, 1995, abandoned.

[30] Foreign Application Priority Data

Jan. 25, 1995 [JP] Japan ..... 7-043362

[51] Int. Cl.[6] ..... A63H 33/04

[52] U.S. Cl. ..... 446/92; 446/131; 446/138

[58] Field of Search ..... 446/92, 131, 134, 446/129, 138

[56] References Cited

U.S. PATENT DOCUMENTS 2,795,893 6/1957 Vayo ..... 446/92
3,254,440 6/1966 Duggar ..... 446/92
4,238,905 12/1980 MacGraw, II ..... 446/92
5,347,253 9/1994 Ogikubo ..... 446/92

*Primary Examiner*—Robert A. Hafer
*Assistant Examiner*—Jeffrey D. Carlson
*Attorney, Agent, or Firm*—Oblon, Spivak, McClelland, Maier & Neustadt, P.C.

[57] ABSTRACT

A block toy is composed of a plurality of blocks magnetically connectable to each other. At least one of the blocks comprises a block main body having plural flat surface portions, magnet holding portions formed on inner sides of the respective flat surface portions, and permanent magnets accommodated within the respective magnet holding portions for rotation about imaginary axes extending at right angles relative to the flat surface portions corresponding to the magnet holding portions. The magnet holding portions may be in the form of magnet holders arranged on the inner sides of the respective flat surface portions. The magnet holders may preferably be connected together so that the resulting connected magnet holder has a cross-sectional shape substantially similar to the corresponding cross-sectional shape of the block main body formed by the corresponding plural flat surface portions.

13 Claims, 4 Drawing Sheets

MAGNETIC TOY BLOCKS

This application is a Continuation of application Ser. No. 08/523,491, filed on Sep. 1, 1995, now abandoned.

BACKGROUND OF THE INVENTION a) Field of the Invention

This invention relates to a block toy, and especially to a block toy in which a plurality of blocks, each of which has flat surface portions, can be magnetically connected together in a desired direction without limitation to the direction of their connection by bringing their flat surface portions into contact with each other, thereby permitting creation of a variety of connected structures.

b) Description of the Related Art

A wide variety of block toys have heretofore been developed, including those permitting connection of individual blocks by mutually snapping concave portions and convex portions formed in and on the individual blocks and those making use of a magnet arranged on a block and a magnetic member arranged on another block so that these blocks can be connected together by magnetic force.

Of the above-described conventional block toys, the former type of block toys in which individual blocks are connected together by mutual snapping of concave portions and convex portions formed in and on the individual blocks are limited in the direction of connection. A limitation is therefore obviously imposed on structures which can be formed by connecting the blocks. The latter type of block toys, which make use of blocks provided with magnets and blocks having magnetic members, are also limited in the direction of connection, resulting in a limitation to structures available from connection of their blocks.

SUMMARY OF THE INVENTION

An object of the present invention is to provide a block toy which makes use of magnets, permits connection of plural blocks in a desired direction without limitation to the direction of connection and enables to create a variety of connected structures.

As a result of an extensive investigation, the present inventor has found that the above object of the present invention can be achieved by accommodating a permanent magnet on an inner side of each of plural flat surface portions of at least one of blocks of a block toy so that the permanent magnet is rotatable about an imaginary axis extending at a right angle relative to the corresponding flat surface portion.

In one aspect of the present invention, there is thus provided a block toy composed of a plurality of blocks magnetically connectable to each other. At least one of said blocks comprises a block main body having plural flat surface portions, magnet holding portions formed on inner sides of said respective flat surface portions; and permanent magnets accommodated within said respective magnet holding portions for rotation about imaginary axes extending at right angles relative to said flat surface portions corresponding to said magnet holding portions.

In another aspect of the present invention, there is also provided a block toy composed of a plurality of blocks magnetically connectable to each other. At least one of said blocks comprises a block main body having plural flat surface portions, a like plural number of magnet holders arranged on inner sides of said respective flat surface portions and having magnet holding portions extending in parallel with said corresponding flat surface portions, and permanent magnets accommodated within said magnet holding portions of said magnet holders for rotation about imaginary axes extending at right angles relative to said flat surface portions corresponding to said magnet holding portions.

According to each block toy of the present invention, plural blocks can be connected together at any desired flat surface portions thereof without limitation to the direction of connection when the desired flat surface portions of the plural block bodies are brought into contact with each other.

It is however to be noted that depending on the orientation of the magnets located on the inner sides of the mutually-opposing flat surface portions of two blocks to be connected, their N poles, that is, their S poles may be located close to each other. Even in such a situation, the two blocks can still be connected together for the reason to be mentioned next. Namely, when the flat surface portions are brought close to each other or into contact with each other, the permanent magnets inside the blocks are caused to rotate under repulsive force developed between the magnetic poles of the same polarity and also under attractive force developed between the magnetic poles of the opposite polarities. As a consequence, the magnetic poles of the opposite polarities are attracted to each other so that the two blocks can be connected together.

Needless to say, the magnetic force of each permanent magnet is set at such a level that an infant or child in an age range for which the block toy of the present invention is intended can easily disconnect the blocks so connected by magnetic force.

Owing to the above-described construction, each block toy according to the present invention makes it possible to connect plural blocks together in a desired direction without limitation to the direction of connection, so that a variety of structures can be created. Each block toy according to the present invention is therefore effective as an educational toy for developing the creativity of infants.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE INVENTION AND PREFERRED EMBODIMENTS

Figure 1:
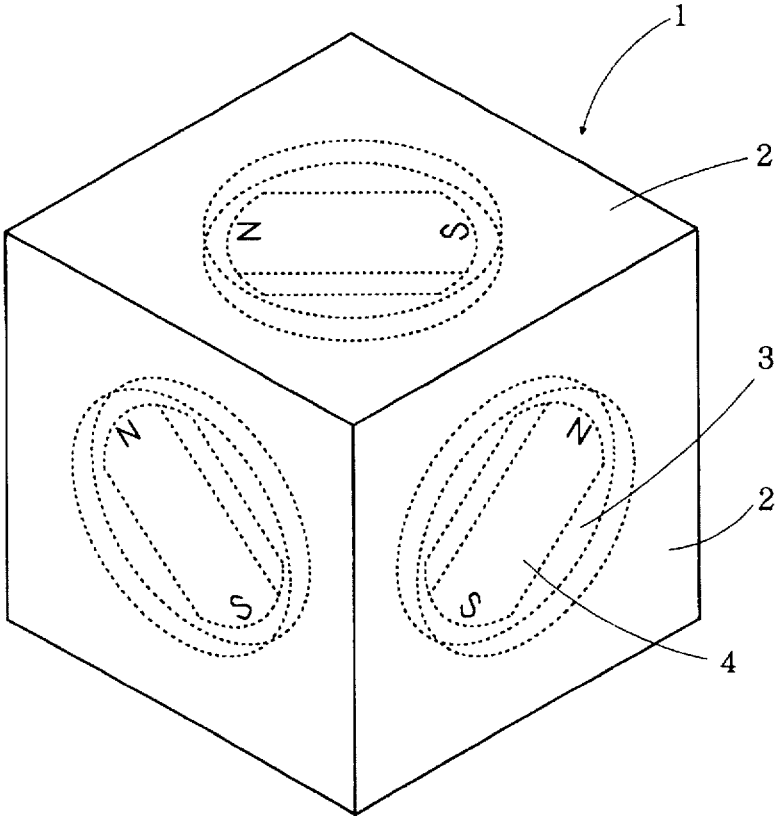
FIG. 1 is a perspective view of one of blocks in a block toy according to a first embodiment of the present invention.

In each block toy according to the present invention, the block main body of each block is formed by injection molding or the like, using a plastic material, preferably, a plastic material such as polyethylene, polypropylene or ABS resin. As the block toy according to the present invention is intended especially for children in a low age range, that is, infants, it is preferred to mold each block main body with an antimicrobial plastic material containing an antimicrobial substance harmless to infants, for example, zinc oxide so that harmful microorganisms or the like can be prevented from growing on surfaces of the block main body.

Further, with a view to spurring infants' interests in the block toy and also developing infants' imagination, it is preferred to make block main bodies with plastic materials of different colors into various shapes, for example, cubes, rectangular parallelepipeds, cylinders and prisms, and shapes formed by combining such shapes with one or more curved surfaces.

Regarding the shape of each permanent magnet usable in the present invention, no particular limitation is imposed insofar as the permanent magnet can be rotatably accommodated within the magnet holding portion on the inner side of the corresponding flat surface portion of the block main body. Each permanent magnet can therefore be formed into a bar, a plate, a disk or the like. To facilitate rotation of the permanent magnet inside the block main body, it is however preferred to use a disk-shaped permanent magnet whose N pole and S pole are located at positions diametrically opposite to each other, that is, at antipodal positions. Further, from the standpoint of magnetic force and formability, it is preferred to form such a disk-shaped permanent magnet by using anisotropic ferrite.

It is known that the magnetic force of a permanent magnet can be significantly intensified by arranging a magnetic member, for example, a thin iron plate on an inner side of the permanent magnet. To obtain magnetic force of a predetermined value, the combined use of such a magnetic member can substantially reduce the production cost compared with the use of a permanent magnet alone.

When a disk-shaped permanent magnet is used as described above, it is preferred to use a disk of a magnetic material having substantially the same diameter as the disk-shaped permanent magnet in such a way that the disk of the magnetic material is magnetically attracted to the inner side of the disk-shaped permanent magnet.

To form the magnet holding portions on the inner sides of the plural flat surface portions of at least one block, various methods can be contemplated. For example, to facilitate the assembly work, it is desired to use a magnet holder equipped with magnet holding portions which can rotatably accommodate the permanent magnets therein. Preferably, the magnet holder can be formed with a flexible, i.e., bendable plastic material by injection molding or the like in such a shape that the plural magnet supports corresponding to the respective plural flat surface portions are connected with each other. It is preferred that in a bent form, the magnet holder has a similar shape as the shape of the block main body formed of the corresponding plural flat surface portions and somewhat smaller dimensions than the block main body.

This makes it possible to maintain the magnet holder in contact with inner walls of the block main body and hence to hold the magnet holder within the block main body by placing the permanent magnets in the respective magnet holding portions of the magnet holder and then inserting the magnet holder into the block main body through a magnet holder insertion opening (in general, this insertion opening is defined by forming the block main body without one of flat surface portions thereof). After the insertion, the missing flat surface portion is applied by an adhesive to close up the insertion opening, whereby the block is completed.

Because of the use of the permanent magnets, it is necessary to pay attention so that the block toy according to the present invention is not brought close to magnetic or magnetic force products such as video tapes, ATM cards and floppy disks.

Based on the preferred embodiments of the present invention illustrated in the accompanying drawings, the constitution of the present invention will hereinafter be described more specifically.

Figure 2:
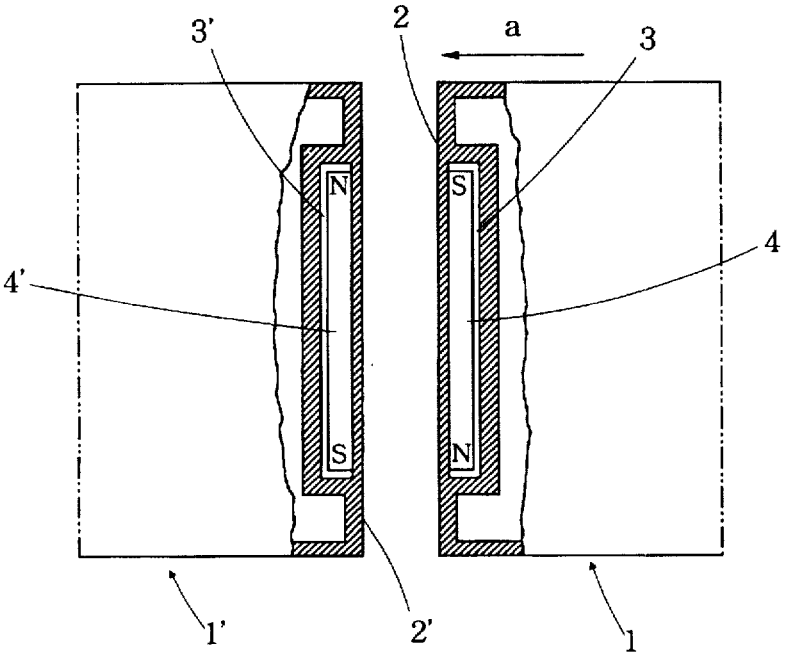
FIG. 2 is a fragmentary cross-sectional view of two blocks in the block toy according to the first embodiment of the present invention.

Referring first to FIGS. 1 and 2, the block toy according to the first embodiment of the present invention will be described. A block main body 1 shown in FIG. 1 is one of blocks making up the block toy and has a cubic shape. The block main body 1 is formed of six flat surface portions 2. On inner sides of the six flat surface portions 2, magnet holding portions 3 are formed, respectively. In each magnet holding portion 3, a permanent magnet 4 in the form of a short bar is accommodated for rotation, that is, rotatably.

An N pole is formed at one end of the permanent magnet 4, while an S pole is formed at an opposite end of the permanent magnet 4. When one of the flat surface portions 2 of the block 1 is moved close to one of flat surface portions 2' of another block 1' as indicated by an arrow a in FIG. 2, the permanent magnet 4 rotatably accommodated within the magnet holding portion 3 and a permanent magnet 4' accommodated for rotation within a magnet holding portion 3' are attracted to each other between their N poles and S poles so that the permanent magnets 4,4' are caused to rotate within the corresponding magnet holding portions 3,3'. As a consequence, the blocks 1 and 1' are connected together with the flat surface portions 2,2' maintained in a contiguous relationship.

However, depending on the orientation of the permanent magnets 4,4', their N poles may be located close to each other, and so can their S poles. Even in such a situation, the permanent magnets 4,4' can be caused to rotate within their corresponding magnet holding portions 3,3', owing to repulsion between the magnetic poles of the same polarity and attraction between the magnetic poles of the opposite polarities by bringing the flat surface portions 2,2' close to each other or into contact with each other. As is illustrated in FIG. 2, the magnetic poles of the opposite polarities are hence attracted to each other, whereby the blocks 1 and 1' are connected together with the flat surface portions 2,2' maintained in a contiguous relationship.

Figure 3:
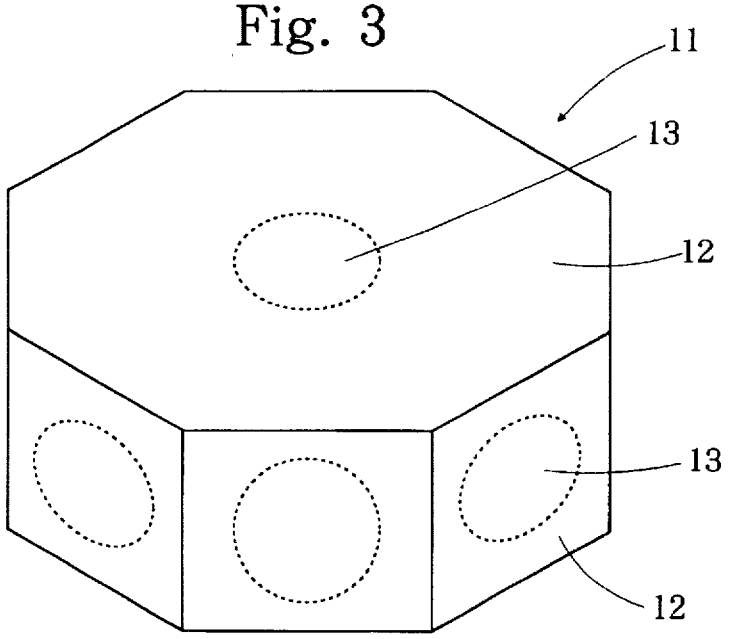
FIG. 3 is a perspective view of one of blocks in a block toy according to a second embodiment of the present invention.
Figure 4:
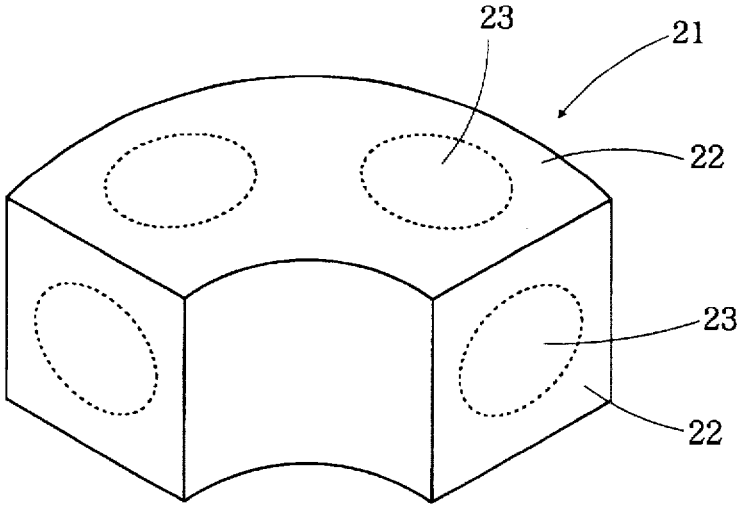
FIG. 4 is a perspective view of one of blocks in a block toy according to a third embodiment of the present invention.

Insofar as blocks have such a basic construction as described above, the blocks can be readily connected together indefinitely in any direction via their flat surface portions. Further, as are illustrated in FIG. 3 and FIG. 4, block main bodies 11,21 can be formed into desired shapes. Magnet holding portions 13,23 are formed likewise on inner sides of individual flat surface portions 12,22. Although not shown in the drawings, permanent magnets are accommodated within the magnet holding portions 13,23 as depicted in FIGS. 3 and 4 By connecting such blocks in various ways, a wide variety of connected structures can be created.

Figure 5:
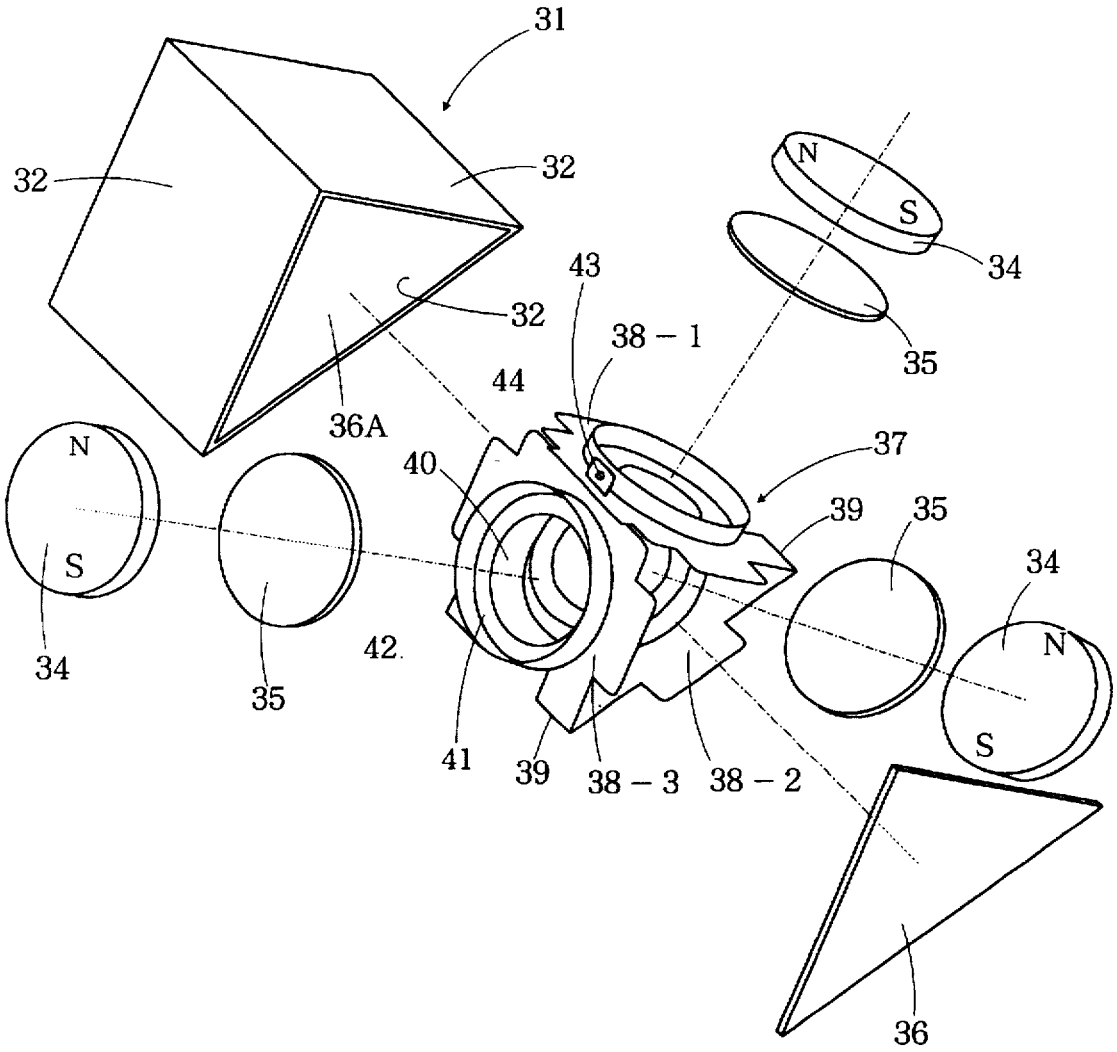
FIG. 5 is an exploded perspective view of a prismatic block in a block toy according to a fourth embodiment of the present invention.
Figure 6:
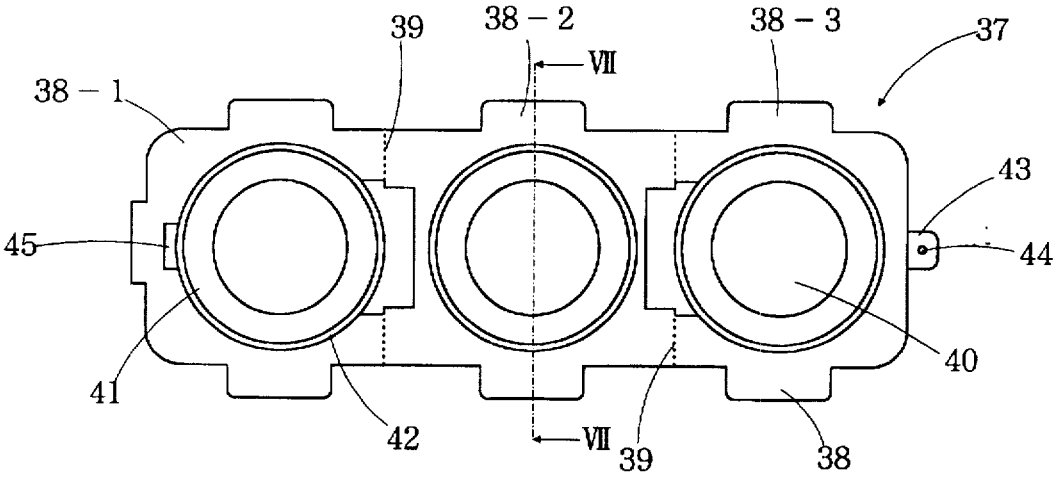
FIG. 6 is a plan view of a magnet holder employed in the prismatic block in the block toy according to the fourth embodiment of the present invention, in which the magnet holder is shown in a developed form.
Figure 7:
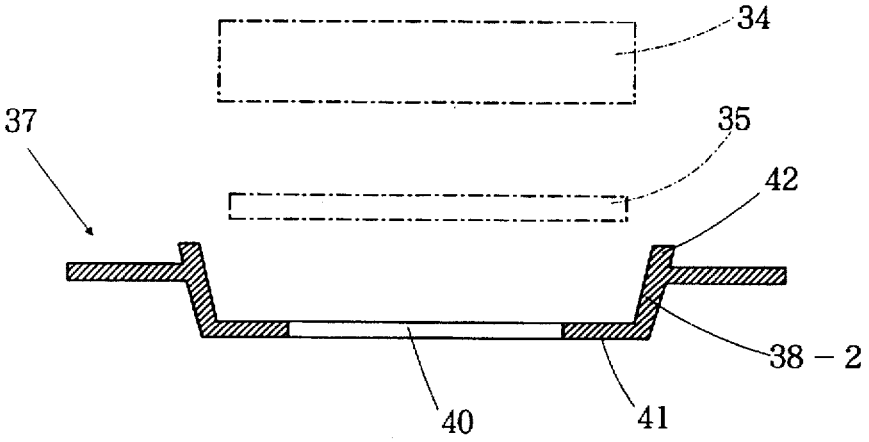
FIG. 7 is an enlarged cross-sectional view of the magnet holder taken in the direction of arrows VII—VII of FIG. 6.

Referring next to FIG. 5 through FIG. 7, the construction of the prismatic block in the block toy according to the fourth embodiment of the present invention will be described. Although the prismatic block will hereinafter be described as a representative example, blocks of other shapes, for example, cubes, rectangular parallelepipeds and cylinders and shapes formed by combining such shapes with one or more curved surfaces are exactly the same in principle as the prismatic block.

A block main body 31 has three flat surface portions 32, on and opposite to whose inner sides disk-shaped permanent magnets 34 to be described subsequently herein are arranged. A triangular plate 36, which forms one of sides walls, is formed as a discrete member, whereby the block main body 31 defines an insertion opening 36A for a magnet holder 37 to be described subsequently herein. Incidentally, the insertion opening is not limited to the side indicated at 36A in the drawing and instead, can obviously be formed by taking out any one of the flat surface portions 32 of the prismatic block main body 31.

As is appreciated from FIGS. 6 and 7, the magnet holder 37 is first molded in the form of a plate by injection molding or the like from a thermoplastic resin similar to that employed for the block main body 31. Described specifically, a base plate 38 is divided via bending portions 39 into three sections 38-1,38-2,38-3 which correspond to the three flat surface portions 32, respectively. In each section, a circular opening 40 is formed almost centrally. The diameter of each circular opening 40 is somewhat smaller than the corresponding permanent magnet 34.

Surrounding each circular opening 40, a circular flange 41 is formed so that the disk-shaped permanent magnet 34 is supported on the flange 41. Formed up right from an outer peripheral edge portion of the circular flange 41 is a short cylindrical portion 42. The diameter of the short cylindrical portion 42 is formed somewhat greater than the diameter of the disk-shaped permanent magnet 34, whereby an inner peripheral wall of the short cylindrical portion 42 serves as a guide for the rotation of the disk-shaped permanent magnet 34.

A tab 43 extends out from a free end edge of the base plate section 38-3 and a bead 44 is formed on the tab 43. On the other hand, a slot 45 (FIG. 6) is formed in the base plate section 38-1 at a location between its free end edge and its short cylindrical portion 42.

Upon assembly of the block, the base plate sections 38-1,38-3 of the magnet holder 37 are first bent along the bending portions 39 downwardly as viewed relative to the drawing sheet of FIG. 6. The tab 43 is then inserted in the slot 45 so that the bead 44 acts as a stopper to allow the magnet holder 37 to retain a prismatic shape. The thus-assembled magnet holder 37 has a substantially similar cross-sectional shape as the block main body 31 and has somewhat smaller dimensions than the block main body 31, so that the magnetic holder 37 can be inserted into the block main body 31 and after the insertion, the magnet holder 37 can be immovably maintained in contact with inner walls of the block main body 31.

Reference is next had to FIG. 7. Within each short cylindrical portion 42, the disk-shaped permanent magnet 34 and a disk-shaped magnetic plate 35 in the form of a thin plate, said magnetic plate 35 having substantially the same diameter as the disk-shaped permanent magnet 34, are placed on the flange 41. Since the disk-shaped plate 35 is made of a magnetic material, the disk-shaped plate 35 is attracted on the disk-shaped permanent magnet 34 and is held within the short cylindrical portion (as a magnet holding portion) 42 for rotation integrally with the disk-shaped permanent magnet 34 about an imaginary axis extending at a right angle relative to the corresponding flat surface portion 32. Incidentally, the diameter of an inner periphery of the circular flange 41 is smaller than the diameter of the disk-shaped plate 35 so that the disk-shaped plate 35 and the disk-shaped permanent magnet 34 are prevented from falling out of the short cylindrical portion 42 through the opening 40. It is however to be noted that the opening 40 is not essential in the present invention and the bottom of the magnet holding portion may be formed in a dish-like shape. The provision of the openings 40 is however preferred from the standpoint of material cost and the rotation of the permanent magnets.

The magnet holder 37 with the disk-shaped plate 35 and the disk-shaped permanent magnet 34 accommodated within each of the short cylindrical portions 42 is then inserted into the block main body 31 through the magnet holder insertion opening 36A. Here, it is preferred to upwardly support the disk-shaped plate 35 and the disk-shaped permanent magnet 34 in the short cylindrical portion 42 of the base plate section 38-2, which is positioned on a lower side, so that the disk-shaped plate 35 and the disk-shaped permanent magnet 34 can be prevented from falling down. As an alternative, the disk-shaped plate 35 and the disk-shaped permanent magnet 34 in the short cylindrical portion 42 of the base plate section 38-2 can be upwardly attracted by a jig which makes use of a magnet.

Subsequent to the insertion of the magnet holder 37 into the block main body 31, the triangular plate 36 is fixed onto edges of the magnet holder insertion opening 36A, in other words, onto end edges of the three flat surface portions 32 with an adhesive. The magnet holder insertion opening 36A is therefore closed up, whereby the prismatic block is completed.

The fourth embodiment of the present invention has been described using the prismatic block main body as a representative example. A magnet holder employed, for example, with a cubic or rectangular parallelepipeddal block main body can be formed by using two base plates of the same type as that shown in FIG. 6, bending them into a square U shape and then combining them together to form a 6-sided magnet holder. Where a block main body is in a cylindrical or other form, the principle of the magnet holder shown in FIG. 6 can be applied equally to provide a magnet holder conforming in shape with the block main body.

The basic structure of the block toy according to the present invention can be applied, for example, for the assembly of miniature buildings, robots, dolls, and vehicle toys such as ships and cars. It is therefore to be noted that block toys making use of the principle of the present invention and useful for the assembly of such structures all fall within the technical concept of the present invention.

What is claimed is:

1. A block toy composed of a plurality of blocks magnetically connectable to each other, wherein at least one of said blocks comprises a hollow block main body having plural flat surface portions, a plural number of magnet holders, corresponding to said plural flat surface portions, arranged on inner sides of said respective flat surface portions and having magnet holding portions extending in parallel with said corresponding flat surface portions, and permanent magnets accommodated within said magnet holding portions of said magnet holders for rotation about imaginary axes extending at right angles relative to said flat surface portions corresponding to said magnet holding portions;

wherein said plural magnet holders are connected together to form a connected magnet holder; said connected magnet holder having a cross-sectional shape substantially similar to a corresponding cross-sectional shape of the hollow block main body formed by said corresponding plural flat surface portions, said connected magnet holder with said permanent magnets accommodated within said magnet holding portions being positioned within an opening defined on said hollow block main body such that said connected magnet holder is immovably maintained in contact with inner walls of said hollow block main body.

2. A block toy according to claim 1, wherein said hollow block main body has a prismatic shape.

3. A block toy according to claim 2, wherein said connected magnet holder has a triangular shape.

4. A block toy according to claim 1, wherein said hollow block main body and said connected magnet holder have a cubic shape.

5. A block toy according to claim 1, wherein each of said permanent magnet is a plate-shaped permanent magnet.

6. A block toy according to claim 5, wherein each of said permanent magnets comprises an inner side which is provided with a magnetic member that is magnetically attracted on the inner side of said permanent magnet, each of said permanent magnets further defines a diameter which is substantially equal to a diameter of said magnetic member.

7. A block toy according to claim 5, wherein each of said permanent magnet is made of anisotropic ferrite.

8. A block toy according to claim 1, wherein said block main body is made of an antimicrobial plastic material.

9. A block toy according to claim 1, wherein each of said permanent magnets is a disk-shaped permanent magnet.

10. A block toy according to claim 1, wherein each of said magnet holding portions comprises a flange which supports the permanent magnet.

11. A block toy according to claim 10, wherein said connected magnet holder comprises a plurality of magnet holder openings, each of said magnet holder openings being positioned so as to correspond to each of said magnet holding portions and being centrally located within said flange so as to facilitate a rotation of said permanent magnet within said flange.

12. A block toy according to claim 1, wherein said hollow block main body comprises a thermoplastic resin.

13. A block toy according to claim 1, wherein said connected magnet holder comprises a thermoplastic resin.

* * * * *